US012426659B1

(12) United States Patent
Gryazin

(10) Patent No.: US 12,426,659 B1
(45) Date of Patent: Sep. 30, 2025

(54) HEAD AND NECK RESTRAINT DEVICE FOR USE IN MOTORSPORTS

(71) Applicant: Vasily Stanislavovich Gryazin, Varna (BG)

(72) Inventor: Vasily Stanislavovich Gryazin, Varna (BG)

( * ) Notice: Subject to any disclaimer, the term of this patent is extended or adjusted under 35 U.S.C. 154(b) by 0 days.

(21) Appl. No.: 18/866,567

(22) PCT Filed: Nov. 18, 2024

(86) PCT No.: PCT/IB2024/054256

§ 371 (c)(1),
(2) Date: Nov. 18, 2024

(51) Int. Cl.
*A42B 3/04* (2006.01)

(52) U.S. Cl.
CPC ..... *A42B 3/0473* (2013.01)

(58) Field of Classification Search
CPC ..... A42B 3/0473
USPC ..... 2/468
See application file for complete search history.

(56) References Cited

U.S. PATENT DOCUMENTS 5,272,770 A * 12/1993 Allen ..... A42B 3/0473 2/468
10,343,572 B2 * 7/2019 Knapp ..... B60N 2/882
10,537,147 B1 * 1/2020 Ashline ..... A42B 3/08
2003/0115657 A1 6/2003 Kintzi et al.
2012/0137418 A1 * 6/2012 Nelson ..... B60R 22/00 2/468
2015/0074882 A1 * 3/2015 Dainese ..... A41D 13/0155 2/455
2017/0150767 A1 * 6/2017 Wetzel ..... A63B 71/10

FOREIGN PATENT DOCUMENTS

WO 2013030858 A1 3/2013
WO 2022175881 A1 8/2022

* cited by examiner

*Primary Examiner* — Alissa J Tompkins
*Assistant Examiner* — Catherine M Ferreira
(74) *Attorney, Agent, or Firm* — Georgiy L. Khayet

(57) ABSTRACT

A system for restraining the helmet of a race driver is provided. The system includes a suit designed to be worn by the race driver and including a patch pocket disposed on the back side of the suit; a support plate including a back portion, a left shoulder portion, and a right shoulder portion, the support plate being designed to be inserted into the patch pocket; one or more tethers attached to the support plate and the helmet; a left pocket flap extended from the patch pocket towards a front side of the suit; a right pocket flap extended from the patch pocket towards the front side of the suit; a left fastening system designed to secure the left pocket flap to the front side of the suit; and a right fastening system designed to secure the right pocket flap to the front side of the suit.

20 Claims, 9 Drawing Sheets

HEAD AND NECK RESTRAINT DEVICE FOR USE IN MOTORSPORTS

CROSS-REFERENCE TO RELATED APPLICATIONS

This application is a 371 national phase entry of international PCT application No. PCT/DB2024/054256, entitled "HEAD AND NECK RESTRAINT DEVICE FOR USE IN MOTORSPORTS," filed on May 2, 2024. The aforementioned application is incorporated herein by reference in its entirety for all purposes.

TECHNICAL FIELD

This disclosure relates to the field of safety and protection devices in motorsports. Specifically, the present disclosure relates to systems and methods for restraining the head and neck of a race driver in the event of a collision with an obstacle or overturn of a race car.

BACKGROUND

Traditionally, race drivers use a five or six-point seat belt restrain system, where all the seat belts are connected to a common buckle to hold the race driver's body in the racing seat during a collision. The seat belts restrain the race driver's torso against the racing seat in the car and effectively hold it while driving and in the event of an accident. However, the seat belts are not designed to hold the head and neck of the race driver. Thus, in a crash, and, especially, in a frontal or angled frontal collision, the head of the race driver may continue to move forward or away from the seat, which can lead to serious neck and/or head injuries, or even death.

There are known devices that can be used by race car drivers in competitions to restrain movements of the head and neck during collisions. These devices are approved by the International Automobile Federation (FIA) and are mandatory for use by all drivers in competitions. However, such devices have their shortcomings. One of the shortcomings of one of the known restraint devices is that these restraint devices require specially designed racing seats. The restraint devices with the specially designed racing seats have cumbersome designs that prevent the race drivers from quickly unfastening the seat belts and leaving the car if the driver is injured and urgent medical care is needed. Additional shortcomings of other known restraint devices are that race drivers need to wear the restraint device over the driver's suit, which may obstruct the view of advertising and sponsorship embroidery on the suit, thus having a negative impact on advertisement revenue and development of motorsport.

SUMMARY

This summary is provided to introduce a selection of concepts in a simplified form that are further described in the Detailed Description below. This summary is not intended to identify key features or essential features of the claimed subject matter, nor is it intended to be used as an aid in determining the scope of the claimed subject matter.

According to one example embodiment, a system for restraining the helmet of a race driver is provided. The system may include a support plate. The support plate may include a back portion, a left shoulder portion, and a right shoulder portion. The system may include one or more tethers attached to the support plate and the helmet. The system may also include a suit with a patch pocket disposed on the back side of the suit. The suit can be designed to be worn by the race driver. The patch pocket can be designed to contain the support plate. The patch pocket may include a left pocket flap designed to bent over the left shoulder portion of the support plate and a right pocket flap designed to bent over the right shoulder portion of the support plate. The system may include a left fastening system designed to secure the left pocket flap to the front side of the suit. The system may include a right fastening system designed to secure the right pocket flap to the front side of the suit.

The left fastening system may include a first hook-and-loop fastener and the right fastening system may include a second hook-and-loop fastener. The one or more tethers can be attached to the helmet by at least one quick-release fastener approved by FIA.

The one or more tethers may include a left tether attached to the support plate from a left of the helmet, a right tether attached to the support plate from a right of the helmet, and a rear tether attached to the support plate from a back of the helmet. The rear tether may include a left end and a right end such that the left tether and the left end of the rear tether are attached to the helmet by a first fastener, and the right tether and the right end of the rear tether are attached to the helmet by a second fastener.

The support plate may include a collar portion extending up from the back portion. The rear tether can be attached to the collar portion by an overlay plate. The collar portion may include a first opening and a second opening. The left tether may include a first loop passing through the first opening and the right tether may include a second loop passing through the second opening.

The left shoulder portion may include a left flange extending up from the left shoulder portion such that the collar portion and the left flange form a left cavity. The right shoulder portion may include a right flange extending up from the right shoulder portion such that the collar portion and the right flange form a right cavity. The left pocket flap can be designed to fit the left cavity and the right pocket flap can be designed to fit the right cavity.

When the race driver is seating in a racing seat, the left cavity covered by the left pocket flap can accept a first seat belt and the right cavity covered by the right pocket flap can accept a second seat belt, where the first seat belt and the second seat belt are designed to secure the race driver to the racing seat. The left flange may prevent the first seat belt from sliding left of the race driver and the right flange may prevent the second seat belt from sliding right of the race driver. The first seat belt can be positioned over the left pocket flap and the second seat belt can be positioned over the right pocket flap, thereby allowing to keep the support plate, the left pocket flap, and the right pocket flap placed over the suit at the correct position. In addition, placing the first seat belt over the left pocket flap and the second seat belt over the right pocket flap allows the race driver to freely leave the racing seat when the first seat belt and the second seat belt are unbuckled.

The back portion of the support plate is designed to narrow towards the back of the race driver.

According to another embodiment of the present disclosure, a method for restraining the helmet of a race driver is provided. The method may include providing a support plate including a back portion, a left shoulder portion, and a right shoulder portion. The method may include providing one or more tethers attached to the support plate and the helmet. The method may also include providing a suit including a patch pocket disposed on the back side of the suit. The suit can be designed to be worn by the race driver. The patch pocket can be designed to contain the support plate. The patch pocket may include a left pocket flap designed to bent over the left shoulder portion of the support plate and a right pocket flap designed to bent over the right shoulder portion of the support plate. The method may include providing a left fastening system designed to secure the left pocket flap to the front side of the suit. The method may include providing a right fastening system designed to secure the right pocket flap to the front side of the suit.

Other example embodiments of the disclosure and aspects will become apparent from the following description taken in conjunction with the following drawings.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
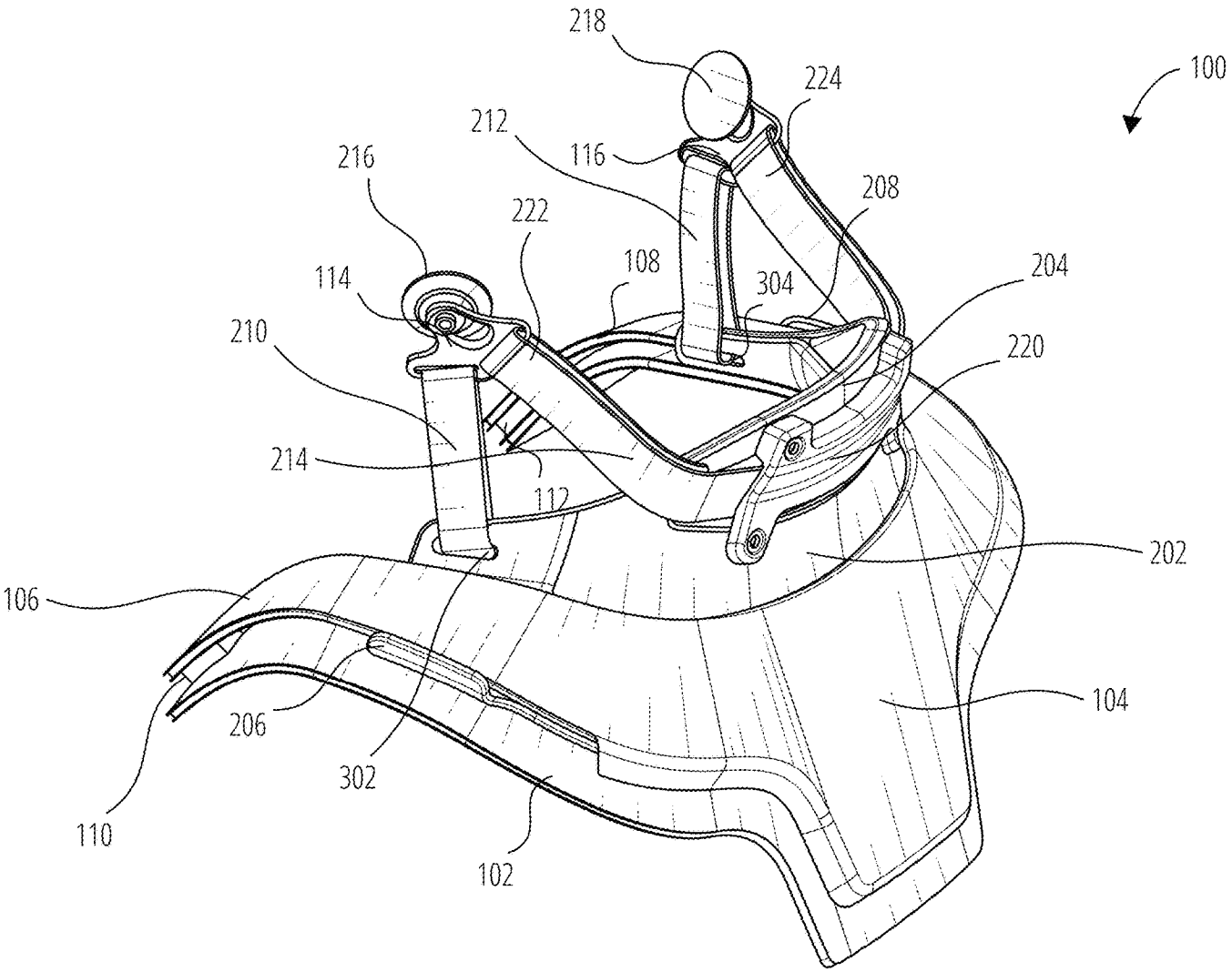
FIG. 1 is a rear top angle view of a system for restraining a helmet of a race driver, according to example embodiment of the present disclosure.

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical, and operational changes can be made without departing from the scope of what is claimed. The following detailed description is, therefore, not to be taken in a limiting sense, and the scope is defined by the appended claims and their equivalents.

Generally, the embodiments of this disclosure are concerned with systems and methods for restraining the head and neck of a race driver in motorsports. Specifically, the system of the present disclosure is designed to restrain movement of a helmet worn by the race driver in the event of an accident, thereby preventing damage to the head and neck. According to example embodiments of the present disclosure, the system for restraining the helmet of the race driver may include a suit designed to be worn by the race driver. The suit may include a patch pocket disposed on the back side of the suit. The system may include a support plate. The support plate may include a back portion, a left shoulder portion, and a right shoulder portion. The support plate can be designed to be inserted into the patch pocket. The system may include one or more tethers attached to the support plate and the helmet to restrain movement of the helmet during an accident. The patch pocket may include a left pocket flap extended from the patch pocket towards the front side of the suit and a right pocket flap extended from the patch pocket towards the front side of the suit. The system may include a left fastening system designed to secure the left pocket flap to the front side of the suit and a right fastening system designed to secure the right pocket flap to the front side of the suit, thereby attaching the support plate to the suit. When getting in the racing seat, the race driver may buckle in seat belts over the left pocket flap and the right pocket flap. Thus, to leave the racing seat in case of emergency, the race driver or an assistant need only to unbuckle the seat belts so the driver may leave the racing car.

Technical effects of certain embodiments of the present disclosure can include reducing a size of a restraint system as compared to existing solutions, specifically eliminating tethers placed over a suit of the race driver to hold a device for restraining the head and neck of the race driver. This prevents covering advertisements and sponsors' patches on the suit. Further technical effects of certain embodiments of the present disclosure include allowing the same device for restraining the head and neck to be used by multiple race drivers. Technical effects of certain embodiments of the present disclosure include allowing seat belts to be placed over the device for restraining the head and neck, so the race driver may easily unbuckle seat belts when needed. Yet other technical effects of certain embodiments of the present disclosure include reducing size and weight of the device for restraining the head and neck to allow decreasing pressure on the shoulders of race drivers and thereby provide the race drivers more comfort and better car control during car races.

Referring now to the drawings, various embodiments are described in which like reference numerals represent like parts and assemblies throughout the several views. It should be noted that the reference to various embodiments does not limit the scope of the claims attached hereto. Additionally, any examples outlined in this specification are not intended to be limiting and merely set forth some of the many possible embodiments for the appended claims.

FIG. 1 is a rear top angle view of system 100 for restraining a helmet of a race driver, according to example embodiment of the present disclosure. System 100 may include a suit 102 (shown partially) designed to be worn by a race driver and a patch pocket 104 located on the back side of the suit 102. The patch pocket 104 may include a left pocket flap 106. Left pocket flap 106 can be a piece of fabric extended from the patch pocket 104 towards the front side of the suit 102. The patch pocket 104 may include a right pocket flap 108. Right pocket flap 108 can be a further piece of fabric extended from patch pocket 104 towards the front side of the suit 102.

Suit 102, patch pocket 104, left pocket flap 106, and right pocket flap 108 can be made from textile fabrics typically used in motorsports, such as durable textile materials like Cordura™ fabrics, Nomex™, nylon, polyester, and other materials having abrasion resistance, flexibility, breathability, and fire resistance. The patch pocket 104 can be sewn to suit 102 with strong threads. Patch pocket 104, left pocket flap 106, and right pocket flap 108 can be made as a single part from the same piece of textile fabric.

System 100 may include a left fastening system 110 and a right fastening system 112 located on the front side of suit 102. The left fastening system 110 can be designed to seal left pocket flap 106 to the front side of suit 102. Correspondently, right fastening system 112 can be designed to seal right pocket flap 108 to the front side of suit 102. In example of FIG. 1, left fastening system 110 includes a first hook-and-loop fastener and right fastening system 112 includes a second hook-and-loop fastener. Both the first hook-and-loop fastener and the second hook-and-loop fastener may include Velcro™ fastener. Other embodiments may include different systems for securing left pocket flap 106 and right pocket flap 108 to the front side of suit 102, for example buckles, D-rings, and so on.

System 100 may include a support plate 202 designed to be inserted into the patch pocket 104. Support plate 202 may include a back portion (covered by patch pocket 104 in FIG. 1), a left right shoulder portion (obscured by left pocket flap 106 in FIG. 1), a right shoulder portion (obscured by right pocket flap 108 in FIG. 1), and collar portion 204. Support plate 202 may include left flange 206 extended top from left shoulder portion and right flange 208 extended top from the right shoulder portion. The back portion can be designed to repeat the shape of the back of a race driver and narrow towards the lower back of the race driver. The left shoulder portion can be designed to repeat the shape of the left shoulder of the race driver. The right shoulder portion can be designed to repeat the shape of the right shoulder of the race driver. Collar portion 204 can be designed to be arranged around the neck of the race driver.

It should be understood that the division of support plate 202 into back portion, left shoulder portion, right shoulder portion, collar portion 204, left flange 206, and right flange 208 is solely for simplicity of the description. Support plate 202 can be made as a single part from a hard material for durability and reliability. The hard material may include metal alloys, high-strength plastics, composite materials and so on.

System 100 may include a system of tethers and fasteners for attaching support plate 202 to a helmet of a race driver, thereby restricting movements of the helmet during an accident. In example of FIG. 1, system 100 includes a left tether 210, a right tether 212, a rear tether 214, a first fastener 216, and a second fastener 218. Left tether 210 can be attached via a loop to first opening 302 made in collar portion 204. Right tether 212 can be attached via a loop to second opening 304 in collar portion 204. Rear tether 214 can be attached to the back side of collar portion 204 by using overlay plate 220. Overlay plate 220 can be secured to the collar portion 204 by screws. Left end 222 of rear tether 214 and left tether 210 can be attached to first fastener 216 via anchor 114. Right end 224 of rear tether 214 and right tether 212 can be attached to second fastener 218 via anchor 116.

In various embodiments, left tether 210, right tether 212, and rear tether 214 can be made from high-strength materials designed to withstand extreme forces, such as but not limited to, nylon, polyester, aramid, polyethylene, and so forth. Anchors 114 and 116 can be made from metal. The first fastener 216 and second fastener 218 can be quick-release fasteners approved by FIA. The first fastener 216 can be designed to be attached to the left side of a helmet of a race driver and the second fastener 218 can be designed to be attached to the right side of the helmet.

Figure 2:
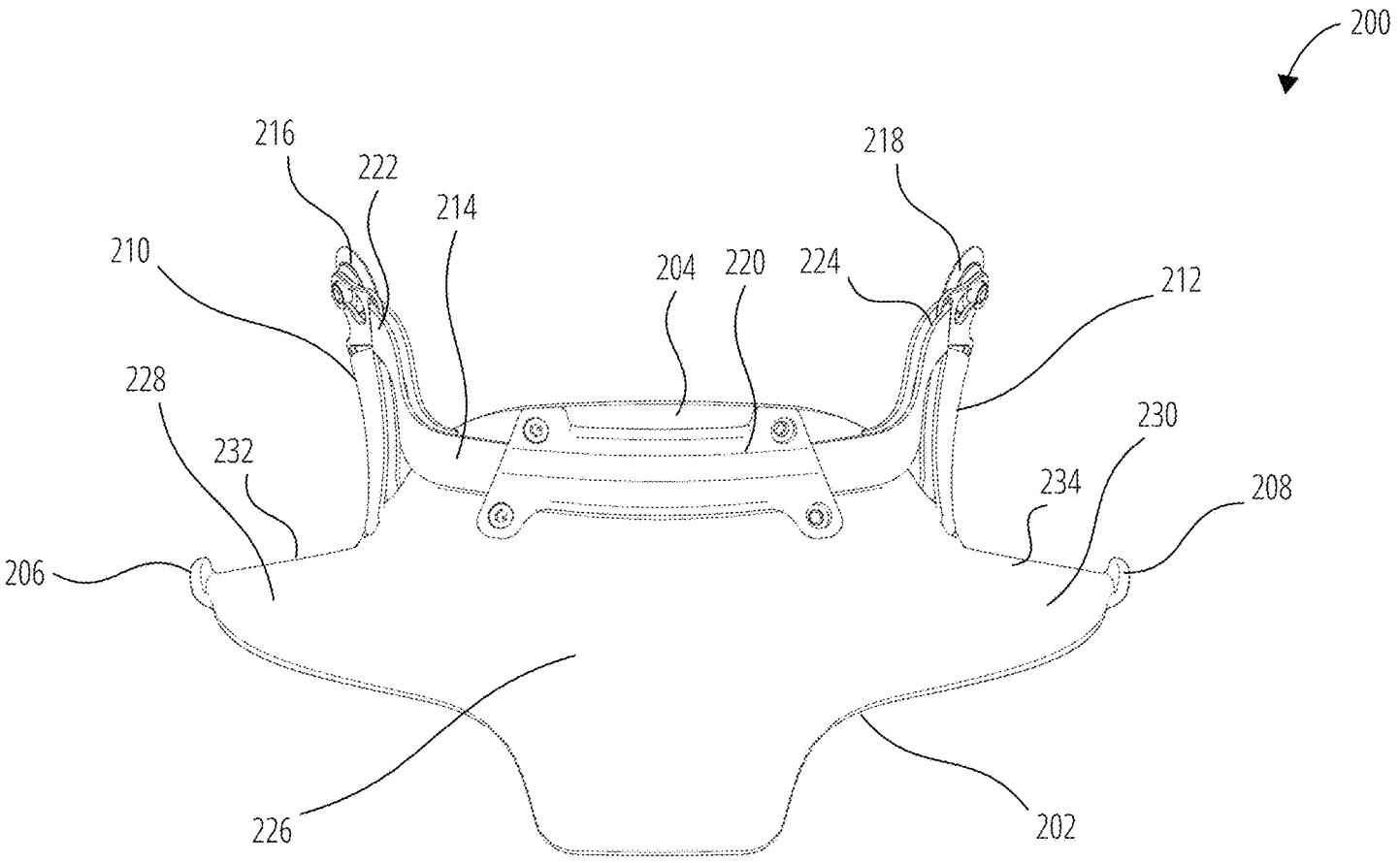
FIG. 2 is a rear view of parts of a system for restraining a helmet of a race driver, according to an example embodiment.

FIG. 2 is a rear view 200 of parts of system 100 for restraining a helmet of a race driver, according to an example embodiment. Specifically, FIG. 2 depicts support plate 202, left tether 210, right tether 212, rear tether 214, first fastener 216, second fastener 218, collar portion 204 of support plate 202, overlay plate 220, left flange 206 of support plate 202, right flange 208 of support plate 202, left end 222 of rear tether 214, right end 224 of rear tether 214, a back portion 226 of support plate 202, left shoulder portion 228 of support plate 202, and right shoulder portion 230 of support plate 202 described above in FIG. 1. As shown in FIG. 2, left flange 206 and collar portion 204 form left cavity 232. Right flange 208 and collar portion 204 form right cavity 234.

Figure 3:
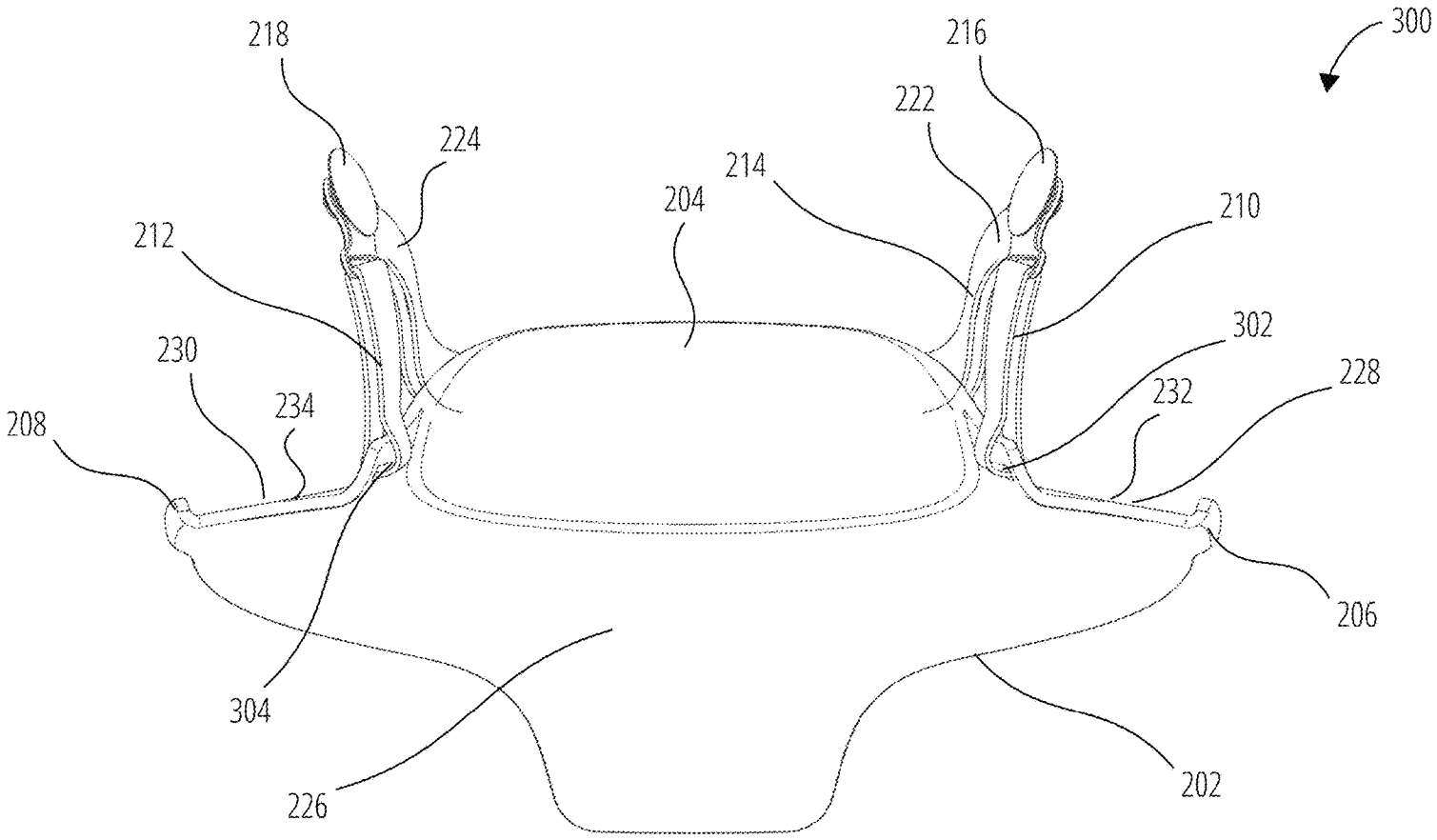
FIG. 3 is a front view of parts of a system for restraining a helmet of a race driver, according to an example embodiment.

FIG. 3 is a front view 300 of parts of system 100 for restraining a helmet of a race driver, according to an example embodiment. Specifically, FIG. 3 depicts support plate 202, back portion 226 of support plate 202, left shoulder portion 228 of support plate 202, right shoulder portion 230 of support plate 202, collar portion 204 of support plate 202, first opening 302 of collar portion 204, and second opening 304 of collar portion 204, left flange 206, a left cavity 232, a right cavity 234, right flange 208, rear tether 214, left tether 210, right tether 212, first fastener 216, second fastener 218, left end 222 of rear tether 214, and right end 224 of rear tether 214 described above in FIG. 1-2.

Figure 4:
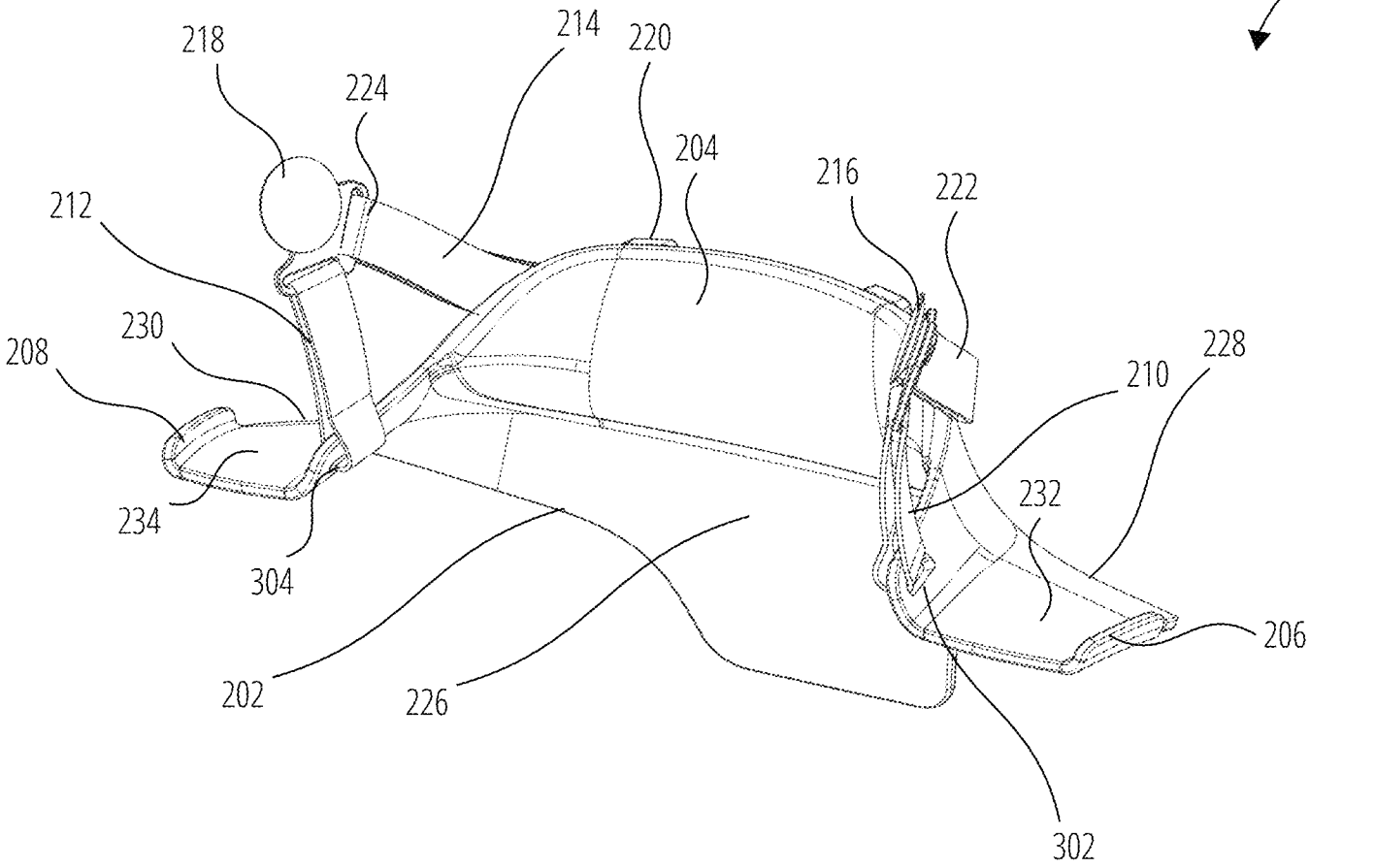
FIG. 4 is a front top angle view of parts of a system for restraining a helmet of a race driver, according to an example embodiment.

FIG. 4 is a front top angle view 400 of parts of system 100 for restraining a helmet of a race driver, according to an example embodiment. Specifically, FIG. 3 depicts support plate 202, collar portion 204, back portion 226, a left shoulder portion 228, a right shoulder portion 230, a left cavity 232, a right cavity 234, a first opening 302, a second opening 304, left flange 206, right flange 208, left tether 210, right tether 212, rear tether 214, first fastener 216, second fastener 218, overlay plate 220, left end 222, and right end 224 described above in FIG. 1-2.

Figure 5:
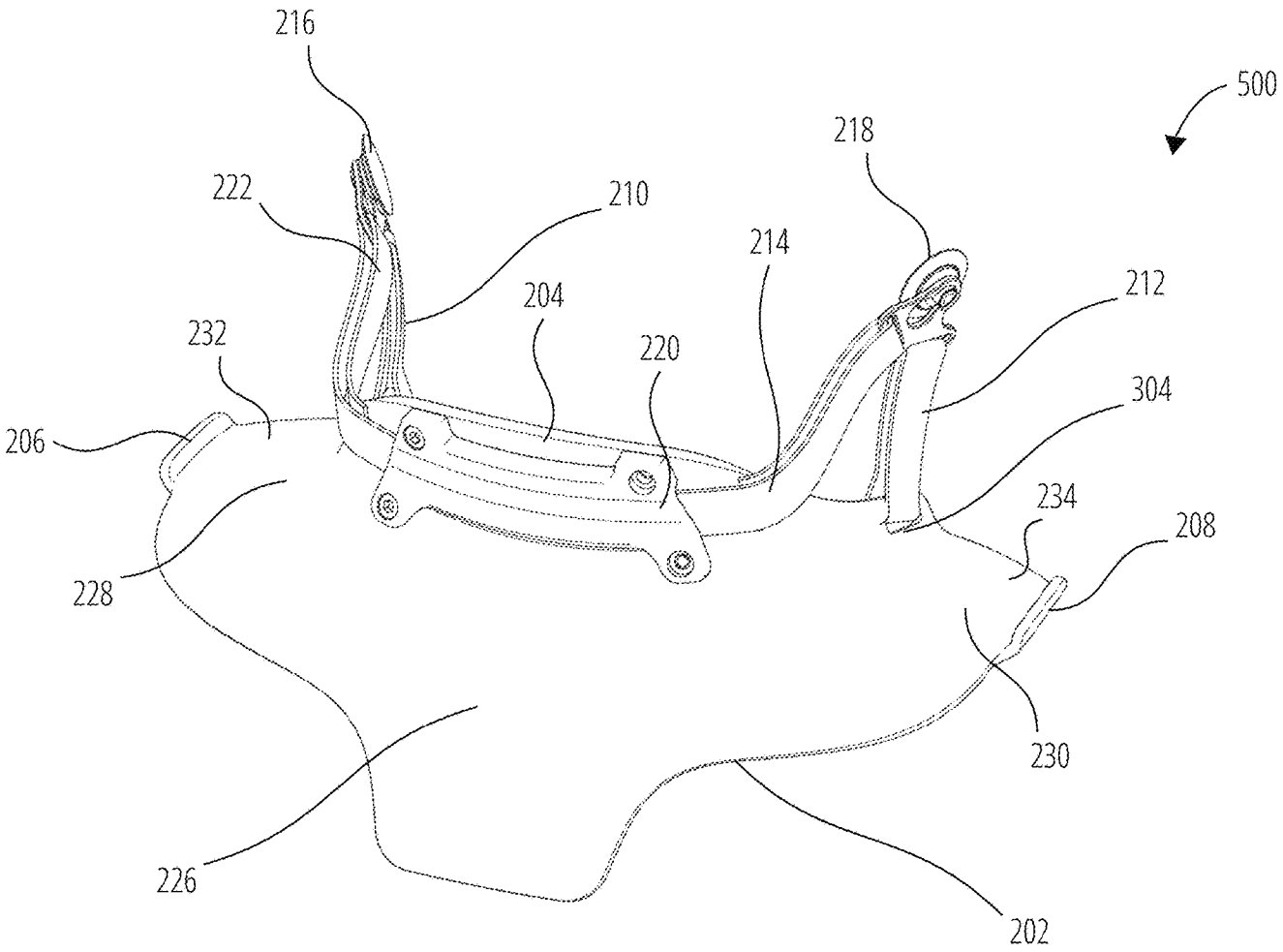
FIG. 5 is rear top angle view of parts of a system for restraining a helmet of a race driver, according to an example embodiment.

FIG. 5 is rear top angle view 500 of parts of system 100 for restraining a helmet of a race driver, according to an example embodiment. Specifically, FIG. 5 depicts support plate 202, collar portion 204, back portion 226, left shoulder portion 228, right shoulder portion 230, left flange 206, right flange 208, second opening 304, left tether 210, left cavity 232, right cavity 234, right tether 212, rear tether 214, a first fastener 216, second fastener 218, an overlay plate 220, and left end 222 of rear tether 214 described in FIG. 1-2.

Figure 6:
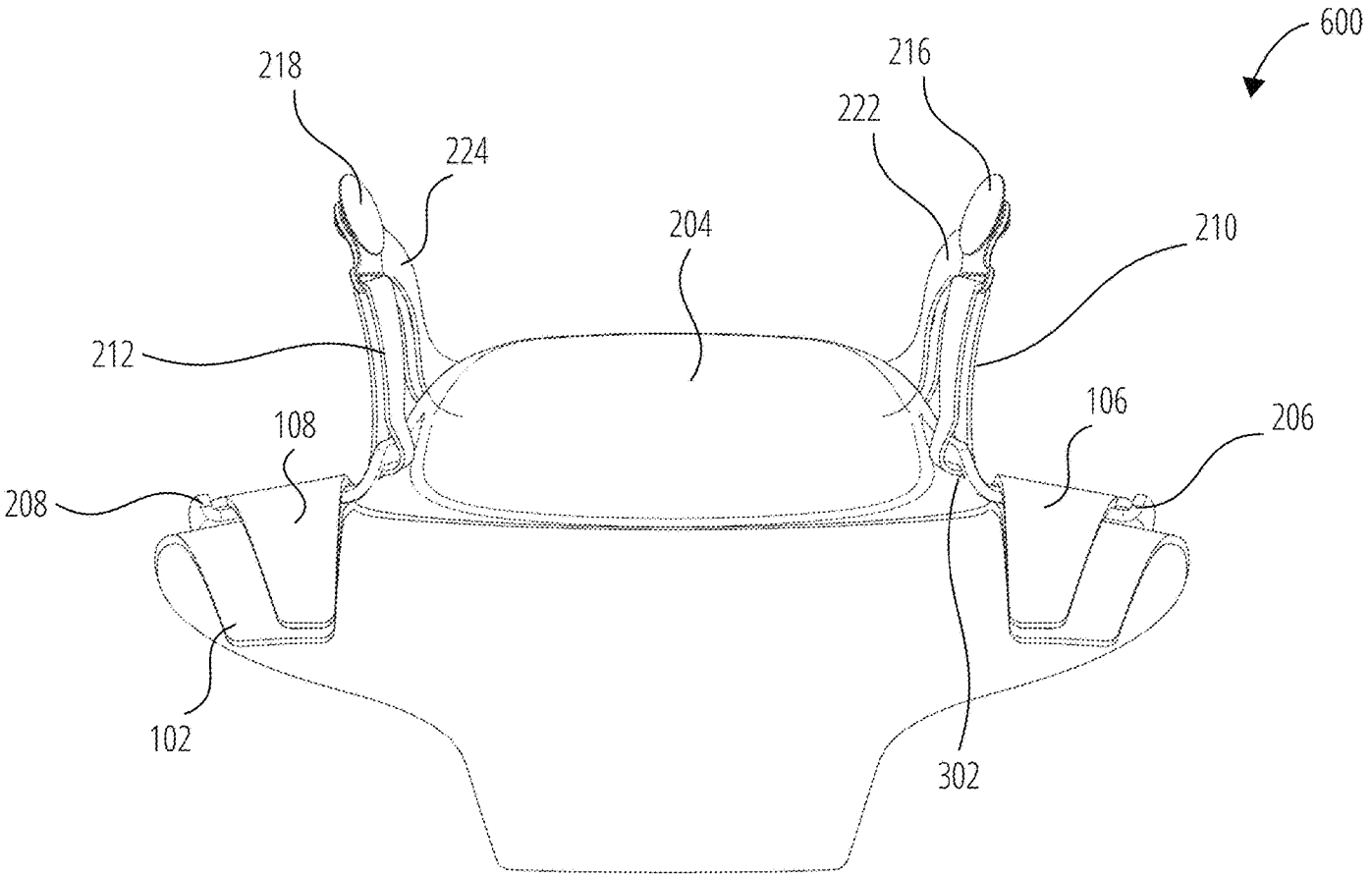
FIG. 6 is a front view of a system for restraining a helmet of a race driver, according to an example embodiment.

FIG. 6 is a front view 600 of system 100 for restraining a helmet of a race driver, according to an example embodiment. Specifically, FIG. 6 shows suit 102 (partially depicted), left pocket flap 106, right pocket flap 108, collar portion 204, left flange 206, right flange 208, left tether 210, right tether 212, first fastener 216, second fastener 218, a left end 222 of rear tether, a right end 224 of rear tether, and first opening 302 described in FIG. 1. As shown in FIG. 6, left pocket flap 106 is bent over the left shoulder portion of support plate 202, positioned between left flange 206 and collar portion 204 of support plate 202 and secured to the front side of suit 102. Right pocket flap 108 is bent over the right shoulder portion of support plate 202, positioned between right flange and collar portion 204 of support plate 202 and secured to front side of suit 102. Thus, left pocket flap 106 and right pocket flap 108 attach support plate 202 to suit 102.

Figure 7:
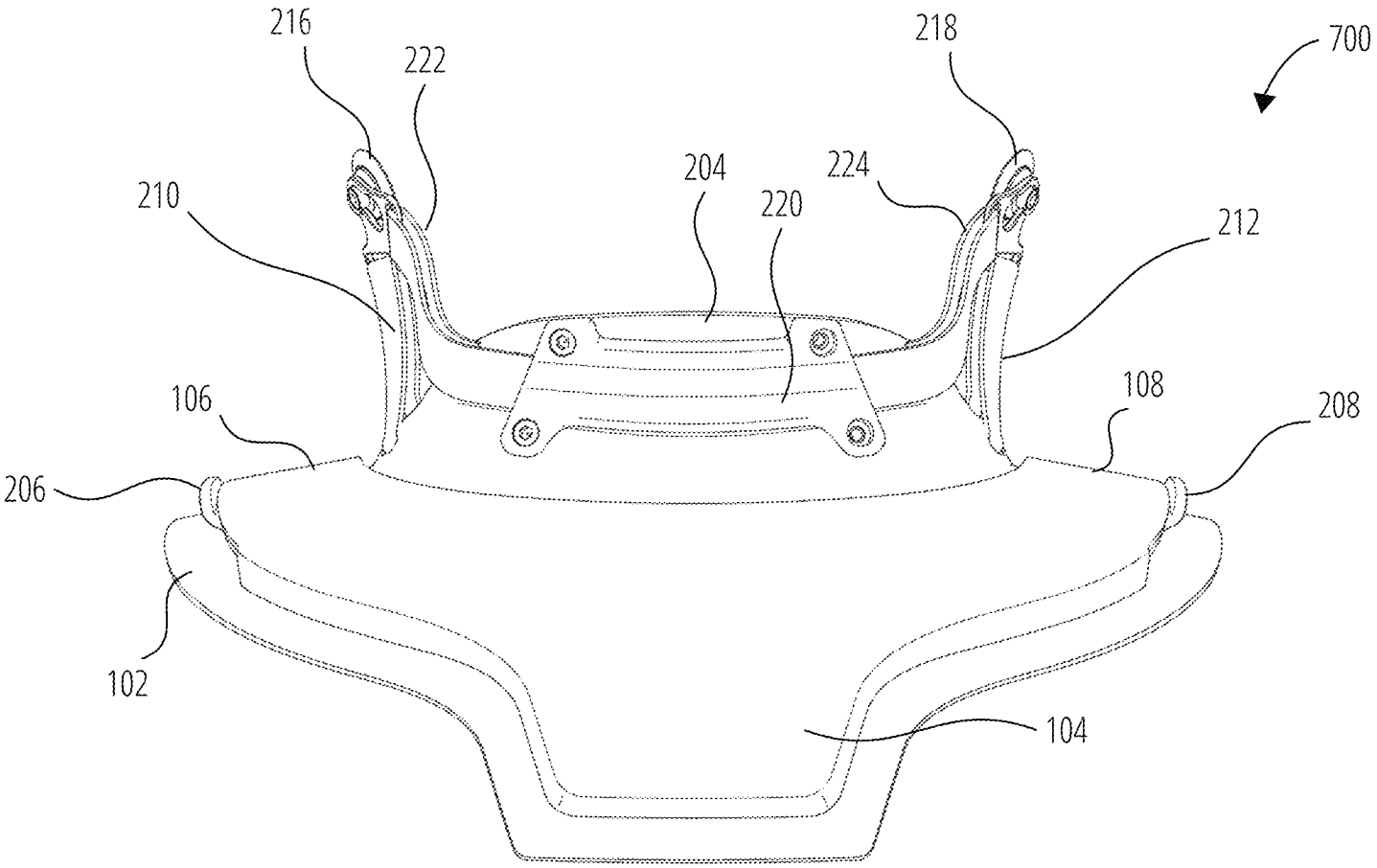
FIG. 7 is a rear view of a system for restraining a helmet of a race driver, according to an example embodiment.

FIG. 7 is a rear view 700 of system 100 for restraining a helmet of a race driver, according to an example embodiment. Specifically, FIG. 7 shows suit 102 (partially), patch pocket 104, left pocket flap 106, right pocket flap 108, collar portion 204, left flange 206, right flange 208, left tether 210, right tether 212, first fastener 216, second fastener 218, overlay plate 220, left end 222 of rear tether 214, and right end 224 of rear tether 214 as described in FIG. 1-6. As shown in FIG. 7, the back portion of support plate 202 is placed in patch pocket 104. Left pocket flap 106 is bent over the left shoulder portion of support plate 202, positioned between left flange 206 and collar portion 204 of support plate 202 and secured to the front side of suit 102. Right pocket flap 108 is bent over the right shoulder portion of support plate 202, positioned between right flange 208 and collar portion 204 of support plate 202 and secured to front side of suit 102. Thus, left pocket flap 106 and right pocket flap 108 attach support plate 202 to suit 102.

Figure 8:
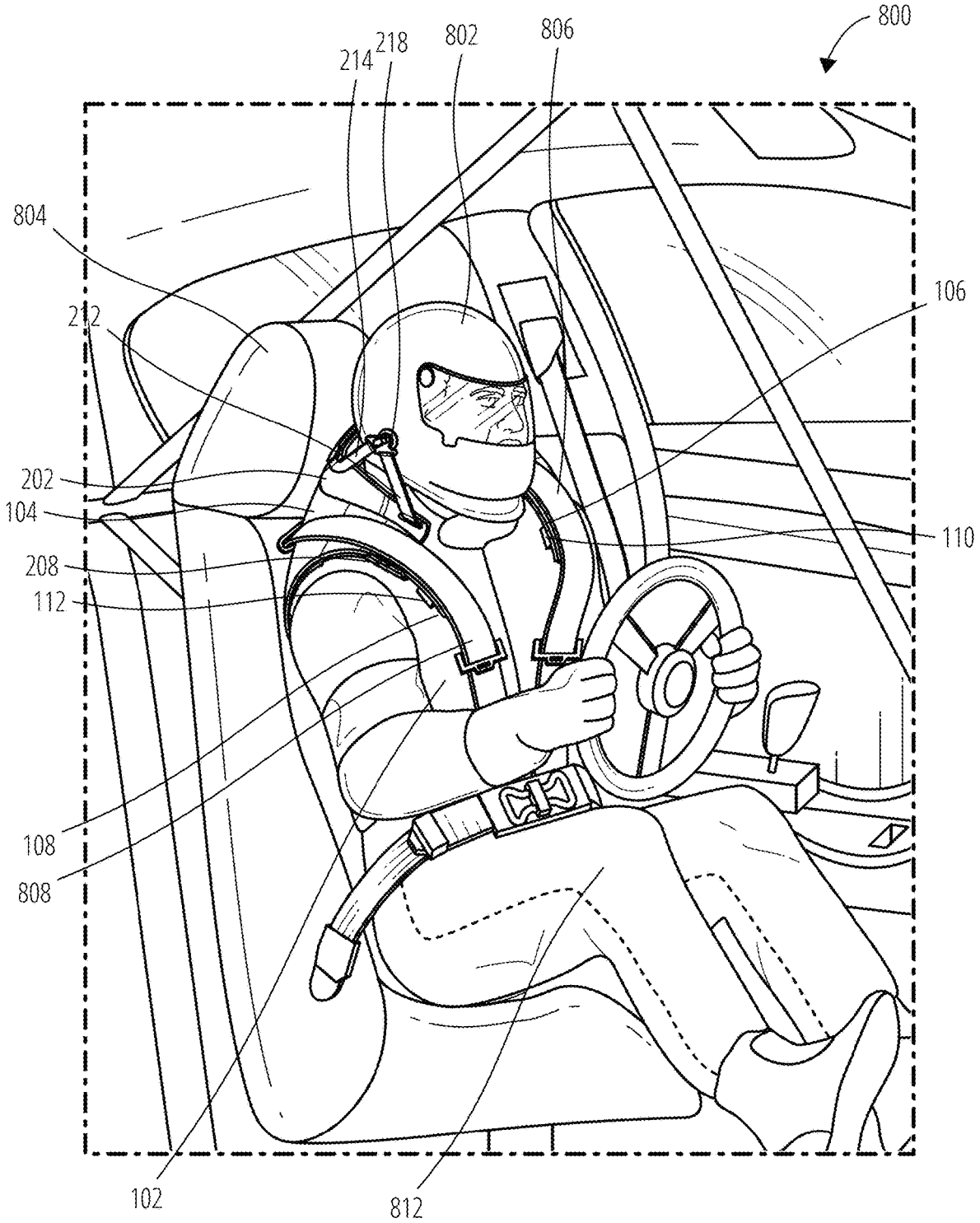
FIG. 8 is a view of a race driver wearing a system for restraining the helmet of the race driver, according to an example embodiment.
Figure 9:
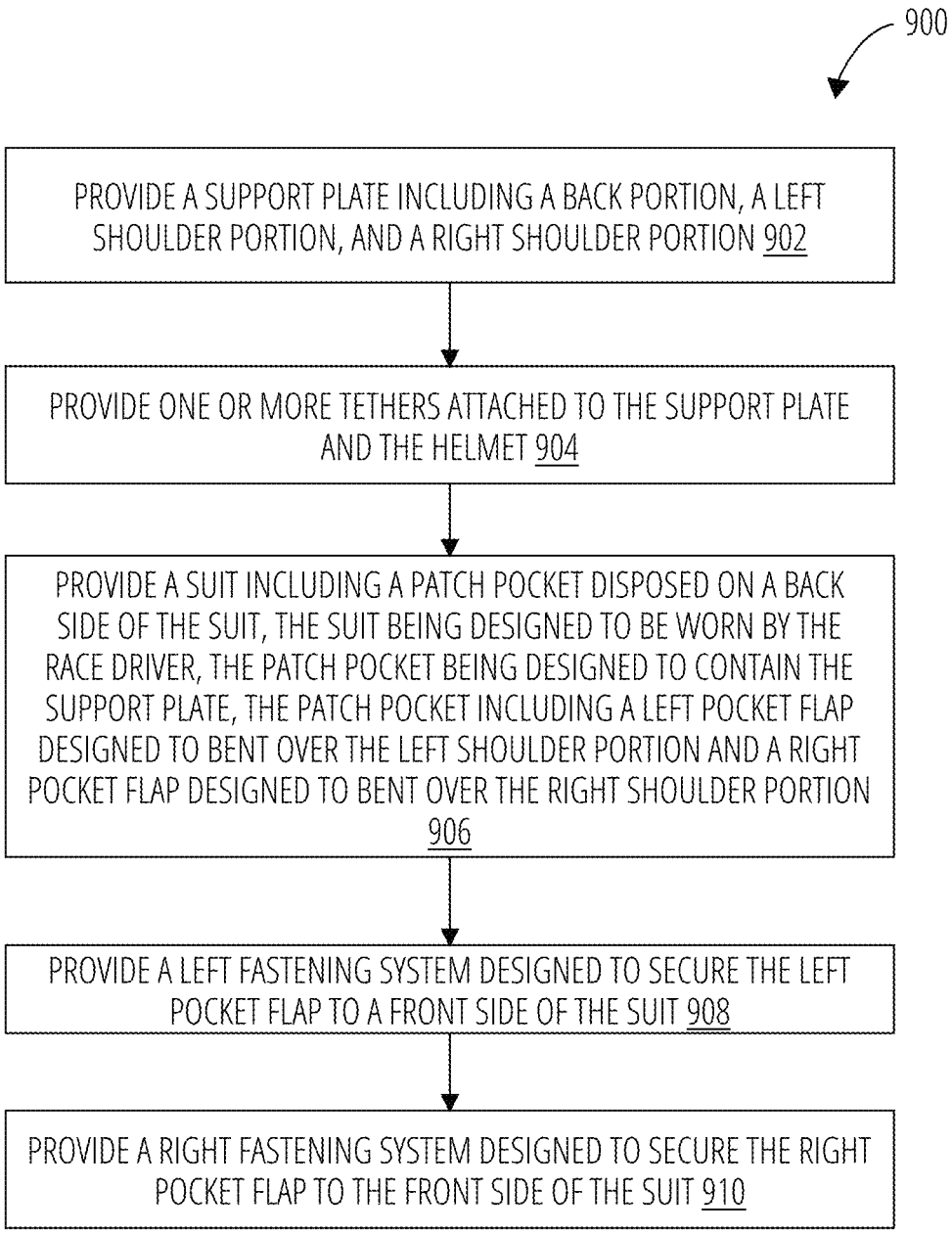
FIG. 9 is a flow chart showing a method for restraining a helmet of a race driver, according to example embodiment of the present disclosure.

FIG. 8 is a view 800 of a race driver 812 wearing system 100 for restraining a helmet 802 of a race driver 812, according to an example embodiment. As shown in FIG. 9, a race driver 812 is seated in racing seat 804. The race driver 812 wears suit 102. Support plate 202 is inserted in patch pocket 104. The left shoulder portion 228 of support plate 202 is placed over suit 102 on the left shoulder of race driver 812. The right shoulder portion 230 of support plate 202 is placed over suit 102 on the right shoulder of race driver 812.

Left pocket flap 106 is bent over the left shoulder portion 228 and secured to the front side of suit 102 via left fastening system 110. Left pocket flap 106 is located between left flange 206 and collar portion 204 of support plate 202. Right pocket flap 108 is bent over right shoulder portion 230 and secured to the front side of suit 102 via right fastening system 112. Right pocket flap 108 is located between right flange 208 and collar portion 204 of support plate 202.

First seat belt 806 is placed over left pocket flap 106 and between collar portion 204 and left flange 206. Thus, left flange 206 may prevent first seat belt 806 from sliding to the left from race driver 812. Second seat belt 808 is placed over right pocket flap 108 and between collar portion 204 and right flange 208. Thus, right flange 208 prevents second seat belt 808 from sliding to the right from race driver 812. Placing the first seat belt 806 over left pocket flap 106 and second seat belt 808 over right pocket flap 108 may additionally help securing left pocket flap 106, right pocket flap 108, and support plate 202 to suit 102 of race driver 812. The first seat belt 806 and second seat belt 808 can be attached behind the racing seat 804 using specialized mounting points and hardware designed to withstand the extreme forces experienced during racing events.

Left tether 210 and rear tether 214 are attached to the left side of helmet 802 via first fastener 216. Right tether 212 and rear tether 214 are attached to right side of helmet 802 via second fastener 218. Thus, because left tether 210, right tether 212, and rear tether 214 are attached to support plate 202, which in turn is secured in patch pocket 104 and suit 102 via left pocket flap 106 and right pocket flap 108, the helmet is restricted in moving quickly left, right, or forward with respect to the racing seat, thereby restricting movement of the head and neck of race driver 812 during an accident. If race driver 812 needs to leave the racing seat and car or assistants need to pull out the race driver 812 in case of emergency, only first seat belt 806 and second seat belt 808 need to be unbuckled. Race driver 812 can leave the racing seat 804 and car without detaching support plate 202 from suit 102 or releasing left tether 210, right tether 212, or rear tether 214 from the helmet 802.

In certain embodiments, the number of fasteners used to secure left pocket flap 106 and right pocket flap 108 to suit 102 can be different from the number of fasteners shown in FIG. 1 and FIG. 8. For example, two and more fasteners can be used for left pocket flap 106 and two and more fasteners can be used for right pocket flap 108. In some embodiments, the shape of left pocket flap 106 and right pocket flap 108 can be different than that shown in FIG. 1 and FIG. 8.

In further embodiments, a single pocket flap can be used instead of left pocket flap 106 and right pocket flap 108. The single pocket flap can be viewed as left pocket flap 106 and right pocket flap 108 joined in single piece. The single pocket flap can be secured to the front site of suit 102 using one fastener or multiple fasteners.

FIG. 9 is a flow chart showing method 900 for restraining a helmet of a race driver, according to example embodiment of the present disclosure. In various embodiments, the operations of method 900 may be combined, performed in parallel, or performed in a different order. The method 900 may also include additional or fewer operations than those illustrated.

In block 902, method 900 may include providing a support plate. The support plate may include a back portion, a left shoulder portion, and a right shoulder portion. The back portion of the support plate can be designed to narrow towards the back of the race driver.

In block 904, method 900 may include providing one or more tethers attached to the support plate and the helmet. The one or more tethers can be attached to the helmet by at least one quick-release fastener approved by the FIA. The one or more tethers may include a left tether attached to the support plate from the left of the helmet, a right tether attached to the support plate from the right of the helmet, and a rear tether attached to the support plate from the back of the helmet. The rear tether includes a left end and a right end such that the left tether and the left end of the rear tether are attached to the helmet by a first fastener and the right tether and the right end of the rear tether are attached to the helmet by a second fastener.

The support plate may include a collar portion extending up from the back portion. The rear tether is attached to the collar portion by an overlay plate. The collar portion may include a first opening and a second opening. The left tether may include a first loop passing through the first opening. The right tether may include a second loop passing through the second opening.

In block 906, method 900 may include providing a suit with a patch pocket disposed on the back side of the suit. The suit can be designed to be worn by the race driver. The patch pocket can be designed to contain the support plate. The patch pocket may include a left pocket flap designed to bent over the left shoulder portion of the support plate and a right pocket flap designed to bent over the right shoulder portion of the support plate.

In block 908, method 900 may include providing a left fastening system designed to secure the left pocket flap to the front side of the suit. The left fastening system may include a first hook-and-loop fastener.

In block 910, method 900 may include providing a right fastening system designed to secure the right pocket flap to the front side of the suit. The left fastening system may include a first hook-and-loop fastener.

The left shoulder portion may include a left flange extending up from the left shoulder portion. The collar portion and the left flange may form a left cavity. The right shoulder portion may include a right flange extended up from the right shoulder portion. The collar portion and the right flange may form a right cavity. The left pocket flap can be designed to fit the left cavity. The right pocket flap can be designed to fit the right cavity.

The left cavity can be designed to accept a first seat belt designed to secure the race driver to the racing seat according to the requirements of the FIA, national, or regional motorsport federations. The right cavity can be designed to accept a second seat belt designed to secure the race driver to the racing seat according to the requirements of the FIA, national, or regional motorsport federations. The left flange may prevent the first seat belt from sliding to the left of the race driver. The right flange may prevent the second seat belt from sliding to the right of the race driver. The first seat belt can be positioned over the left pocket flap when the left pocket flap is placed over the left cavity. The second seat belt can be positioned over the right pocket flap when the right pocket flap is placed over the right cavity. This may allow the race driver to freely leave the racing seat when the first seat belt and the second seat belt are unbuckled.

Thus, a head and neck restraining system and method for use in motorsports are disclosed. While the present embodiments have been described in connection with a series of embodiments, these descriptions are not intended to limit the scope of the subject matter to the particular forms set forth herein. It will be further understood that the methods are not necessarily limited to the discrete components described. To the contrary, the present descriptions are intended to cover such alternatives, modifications, and equivalents as may be included within the spirit and scope of the subject matter as disclosed herein and defined by the appended claims and otherwise appreciated by one of ordinary skill in the art.

What is claimed is:

1. A system for restraining a helmet of a race driver, the system comprising:

a support plate including a back portion, a left shoulder portion, and a right shoulder portion;

one or more tethers attached to the support plate and the helmet;

a suit designed to be worn by the race driver;

a patch pocket formed of fabric material and affixed to a back side of the suit, the patch pocket defining a compartment configured to receive the support plate, the patch pocket including a left pocket flap and a right pocket flap, each formed from fabric and extending from the patch pocket toward a front side of the suit, the left pocket flap being configured to bend over the left shoulder portion of the support plate and the right pocket flap being configured to bend over the right shoulder portion of the support plate;

a left fastening system designed to secure the left pocket flap to the front side of the suit; and a right fastening system designed to secure the right pocket flap to the front side of the suit.

2. The system of claim 1, wherein the left fastening system includes a first hook-and-loop fastener and the right fastening system includes a second hook-and-loop fastener.

3. The system of claim 1, wherein the one or more tethers are attached to the helmet by at least one quick-release fastener approved by the International Automobile Federation.

4. The system of claim 1, wherein the one or more tethers includes:

a left tether attached to the support plate from a left of the helmet;

a right tether attached to the support plate from a right of the helmet; and a rear tether attached to the support plate from a back of the helmet, the rear tether including a left end and a right end wherein:

the left tether and the left end of the rear tether are attached to the helmet by a first fastener; and the right tether and the right end of the rear tether are attached to the helmet by a second fastener.

5. The system of claim 4, wherein:

the support plate includes a collar portion extending up from the back portion; and the rear tether is attached to the collar portion by an overlay plate.

6. The system of claim 5, wherein:

the collar portion includes a first opening and a second opening;

the left tether includes a first loop passing through the first opening; and the right tether includes a second loop passing through the second opening.

7. The system of claim 5, wherein:

the left shoulder portion includes a left flange extending up from the left shoulder portion, the collar portion and the left flange forming a left cavity;

the right shoulder portion includes a right flange extended up from the right shoulder portion, the collar portion and the right flange forming a right cavity;

the left pocket flap is designed to fit the left cavity; and the right pocket flap is designed to fit the right cavity.

8. The system of claim 7, wherein when the race driver is seated in a racing seat:

the left cavity is designed to accept a first seat belt designed to secure the race driver to the racing seat;

the right cavity is designed to accept a second seat belt designed to secure the race driver to the racing seat;

the left flange prevents the first seat belt from sliding left of the race driver; and the right flange prevents the second seat belt from sliding right of the race driver.

9. The system of claim 8, wherein:

the first seat belt is positioned over the left pocket flap; and the second seat belt is positioned over the right pocket flap, thereby allowing the race driver to freely leave the racing seat when the first seat belt and the second seat belt are unbuckled.

10. The system of claim 1, wherein the back portion of the support plate is designed to narrow towards a back of the race driver.

11. A method for restraining a helmet of a race driver, the method comprising:

providing a support plate including a back portion, a left shoulder portion, and a right shoulder portion;

providing one or more tethers attached to the support plate and the helmet;

providing a suit designed to be worn by the race driver;

providing a patch pocket formed of fabric material and affixed to a back side of the suit, the patch pocket defining a compartment configured to receive the support plate, the patch pocket including a left pocket flap and a right pocket flap, each formed from fabric and extending from the patch pocket toward a front side of the suit, the left pocket flap being configured to bend over the left shoulder portion of the support plate and the right pocket flap being configured to bend over the right shoulder portion of the support plate;

providing a left fastening system designed to secure the left pocket flap to the front side of the suit; and providing a right fastening system designed to secure the right pocket flap to the front side of the suit.

12. The method of claim 11, wherein the left fastening system includes a first hook-and-loop fastener and the right fastening system includes a second hook-and-loop fastener.

13. The method of claim 11, wherein the one or more tethers are attached to the helmet by at least one quick-release fastener approved by the International Automobile Federation.

14. The method of claim 11, wherein the one or more tethers includes:

a left tether attached to the support plate from a left of the helmet;

a right tether attached to the support plate from a right of the helmet; and a rear tether attached to the support plate from a back of the helmet, the rear tether including a left end and a right end wherein:

the left tether and the left end of the rear tether are attached to the helmet by a first fastener; and the right tether and the right end of the rear tether are attached to the helmet by a second fastener.

15. The method of claim 14, wherein:

the support plate includes a collar portion extending up from the back portion; and the rear tether is attached to the collar portion by an overlay plate.

16. The method of claim 15, wherein:

the collar portion includes a first opening and a second opening;

the left tether includes a first loop passing through the first opening; and the right tether includes a second loop passing through the second opening.

17. The method of claim 15, wherein:

the left shoulder portion includes a left flange extending up from the left shoulder portion, the collar portion and the left flange forming a left cavity;

the right shoulder portion includes a right flange extended up from the right shoulder portion, the collar portion and the right flange forming a right cavity;

the left pocket flap is designed to fit the left cavity; and the right pocket flap is designed to fit the right cavity.

18. The method of claim 17, wherein when the race driver is seated in a racing seat:

the left cavity is designed to accept a first seat belt designed to secure the race driver to the racing seat;

the right cavity is designed to accept a second seat belt designed to secure the race driver to the racing seat;

the left flange prevents the first seat belt from sliding left of the race driver; and the right flange prevents the second seat belt from sliding right of the race driver.

19. The method of claim 18, wherein:

the first seat belt is positioned over the left pocket flap; and the second seat belt is positioned over the right pocket flap, thereby allowing the race driver to freely leave the racing seat when the first seat belt and the second seat belt are unbuckled.

20. The method of claim 11, wherein the back portion of the support plate is designed to narrow towards a back of the race driver.

* * * * *